US011399626B2

(12) United States Patent
Chen

(10) Patent No.: US 11,399,626 B2
(45) Date of Patent: Aug. 2, 2022

(54) COSMETICS BRUSH CLEANING DEVICE

(71) Applicant: Anisa International, Inc., Atlanta, GA (US)

(72) Inventor: Shuai Chen, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 282 days.

(21) Appl. No.: 16/569,111

(22) Filed: Sep. 12, 2019

(65) Prior Publication Data

US 2020/0077782 A1 Mar. 12, 2020

Related U.S. Application Data

(60) Provisional application No. 62/730,185, filed on Sep. 12, 2018.

(51) Int. Cl.
*A46B 17/06* (2006.01)
*A46B 5/02* (2006.01)

(52) U.S. Cl.
CPC ..... *A46B 17/06* (2013.01); *A46B 5/021* (2013.01)

(58) Field of Classification Search
CPC . A46B 17/06; A46B 2200/1046; A46B 5/021; A46B 2200/30
See application file for complete search history.

(56) References Cited

U.S. PATENT DOCUMENTS

D174,317 S 3/1955 Dyrud
4,779,300 A 10/1988 Pompe
5,815,876 A 10/1998 Overseth
7,823,244 B2 11/2010 Knopow et al.
D724,752 S * 3/2015 Huang ..... D24/215
9,015,895 B2 4/2015 Filho et al.
D767,226 S * 9/2016 Albers ..... D32/35
D768,945 S 10/2016 Chen
D782,138 S 3/2017 Xavier et al.
9,814,303 B1 11/2017 Waitesmith
D804,189 S 12/2017 Von Berg
D817,571 S 5/2018 Campbell
D824,620 S 7/2018 Xavier et al.
D825,124 S 8/2018 Celia, Jr.
D849,263 S 5/2019 Soutelo Gomes
D866,074 S 11/2019 Tammabattula
(Continued)

FOREIGN PATENT DOCUMENTS

AU 2015221549 5/2016
CN 206314756 8/2015
(Continued)

OTHER PUBLICATIONS

Avon Beauty Connects; Article entitled: "Makeup brush cleaner review", accessed on Aug. 17, 2018, 6 pgs.
(Continued)

*Primary Examiner* — Shay Karls
(74) *Attorney, Agent, or Firm* — Taylor English Duma LLP

(57) ABSTRACT

Example aspects of a cosmetics brush cleaning device and a method for using a cosmetics brush cleaning device are disclosed. The cosmetics brush cleaning device can comprise a frame comprising a body and a hand engagement mechanism coupled with the body; and a cleaning pad coupled with the frame, the cleaning pad comprising at least one projection.

22 Claims, 4 Drawing Sheets

(56) References Cited

U.S. PATENT DOCUMENTS

| | | | | |
|---|---|---|---|---|
| D866,075 | S | 11/2019 | Tammabattula | |
| D872,372 | S | 1/2020 | Tammabattula | |
| D872,939 | S | 1/2020 | Tammabattula | |
| D872,940 | S | 1/2020 | Tammabattula | |
| D882,810 | S | 4/2020 | Sedic | |
| D898,212 | S | 10/2020 | Sedic | |
| D898,213 | S | 10/2020 | Sedic | |
| D900,421 | S | 10/2020 | Puglisi et al. | |
| D902,491 | S | 11/2020 | De La Cruz | |
| D903,891 | S | 12/2020 | Sedic | |
| D903,892 | S | 12/2020 | Sedic | |
| D916,406 | S | 4/2021 | Chen | |
| D925,831 | S | 7/2021 | Yue | |
| 2006/0026784 | A1* | 2/2006 | Moskovich | A46B 5/0062 15/167.1 |
| 2011/0047736 | A1* | 3/2011 | Jimenez | A46B 9/04 15/167.2 |
| 2014/0000052 | A1 | 1/2014 | Filho et al. | |
| 2015/0027495 | A1* | 1/2015 | Xavier | A46B 17/06 134/6 |
| 2015/0052698 | A1* | 2/2015 | Fakier | A46B 17/06 15/104.001 |
| 2016/0113386 | A1* | 4/2016 | Lim | A46B 17/06 134/6 |
| 2018/0028395 | A1 | 2/2018 | Roth et al. | |
| 2021/0153640 | A1 | 5/2021 | Chen | |

FOREIGN PATENT DOCUMENTS

| | | | |
|---|---|---|---|
| CN | 303326477 | | 8/2015 |
| CN | 105147203 | | 12/2015 |
| CN | 303652732 | | 4/2016 |
| CN | 303905374 | | 11/2016 |
| CN | 205993895 | | 3/2017 |
| CN | 205993896 | | 3/2017 |
| CN | 304190470 | | 6/2017 |
| CN | 304239025 | | 8/2017 |
| CN | 304649515 | | 5/2018 |
| CN | 304715037 | | 7/2018 |
| CN | 305763065 | | 5/2020 |
| EP | 2952118 | | 12/2015 |
| EP | 3009033 | | 4/2016 |
| KR | 20130119605 | | 11/2013 |
| KR | 200483042 | | 4/2017 |
| TW | I458453 | * | 3/2008 |

OTHER PUBLICATIONS

Etsy; Article entitled: "Sale! Silicone Makeup Brush cleaner—Cosmetic Make Up Washing Brush Gel Cleaning Mat Foundation Makeup Brush Cleaner Pad Scubbe Board", accessed on Aug. 17, 2018, 7 pgs.

Chen, Shuai; Notice of Allowance for Design U.S. Appl. No. 29/705,612, filed Sep. 13, 2019, dated Dec. 28, 2020, 17 pgs.

dhgate.com; Article entitled: "Mini Vibrating Massage Waterproof Silicon Face Cleaning Device Facial pore Cleansing Brush Face Skin Keep Cleansing Massager Brush Cleaner", located at <https://www.dhgate.com/product/mini-vibrating-massage-waterproof-silicon/417182115.html>, Copyright 2020, 10 pgs.

aliexpress.com; Article entitled: "Head Hair Washing Scalp Shampoo Air Brush Comb Pink Blue Multi-point Massage Brushes Soft Silicone Cleaning Comb", located at <https://www.aliexpress.com/item/4000533392330.html>, copyright 2020, 14 pgs.

Shopee; Article entitled: "Silicone Shower Brush", located at <https://shopee .com.my/Silicone-Dish-Washing-Brush-Bowl-Pot-Pan-Wash-Cleaning-Brushes-Cooking-Tool-Cleaner-Sponges-Scouring-Pads-Kitchen-Aceessories-.85486424.4018001773>, Copyright 2020, 2 pgs.

Kaicker, Anisa Telwar; Notice of Allowance for Design U.S. Appl. No. 29/734,142, filed May 8, 2020, dated May 5, 2022, 9 pgs.

Kaicker, Anisa Telwar; Non-Final Office Action for U.S Design U.S. Appl. No. 29/734,142, filed May 8, 2020, dated Feb. 15, 2022, 20 pgs.

* cited by examiner

COSMETICS BRUSH CLEANING DEVICE

CROSS-REFERENCE TO RELATED APPLICATIONS

The present application claims the benefit of U.S. Provisional Application No. 62/730,185, filed Sep. 12, 2018, which is hereby specifically incorporated by reference herein in its entirety.

TECHNICAL FIELD

This disclosure relates to cosmetics devices. More specifically, this disclosure relates to a brush cleaning device for cleaning cosmetics brushes.

BACKGROUND

Cosmetics brush cleaning devices can define a cleaning surface against which a brush head of a cosmetics brush can be rubbed to remove residue and bacteria in the brush head. Water and/or a cleanser (e.g., soap) can be applied to the cleaning surface for a deeper clean of the brush head. However, a user often has no direction on how much water or cleanser to apply. Furthermore, cleaning surfaces do not penetrate deep enough into the brush head to effectively remove residue and bacteria, or may not penetrate the brush head at all.

Furthermore, cosmetics brush cleaning devices typically can rest on the palm of a user's hand during use, while the user's other hand manipulates the cosmetics brush. As the brush head is rubbed against the cleaning surface, the cosmetics brush cleaning device can slip and slide on the user's palm, making the cosmetics brush cleaning device difficult to retain and frustrating to use.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a cosmetics brush cleaning device comprising a frame comprising a body and a hand engagement mechanism coupled with the body; and a cleaning pad coupled with the frame, the cleaning pad comprising at least one projection.

Also disclosed is a method for using a cosmetics brush cleaning device, the method comprising providing the cosmetics brush cleaning device comprising a body, a hand engagement mechanism, and a cleaning pad; engaging a user's hand with the hand engagement mechanism; contacting a brush head of a cosmetics brush with the cleaning pad; and moving the brush head against the cleaning pad.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
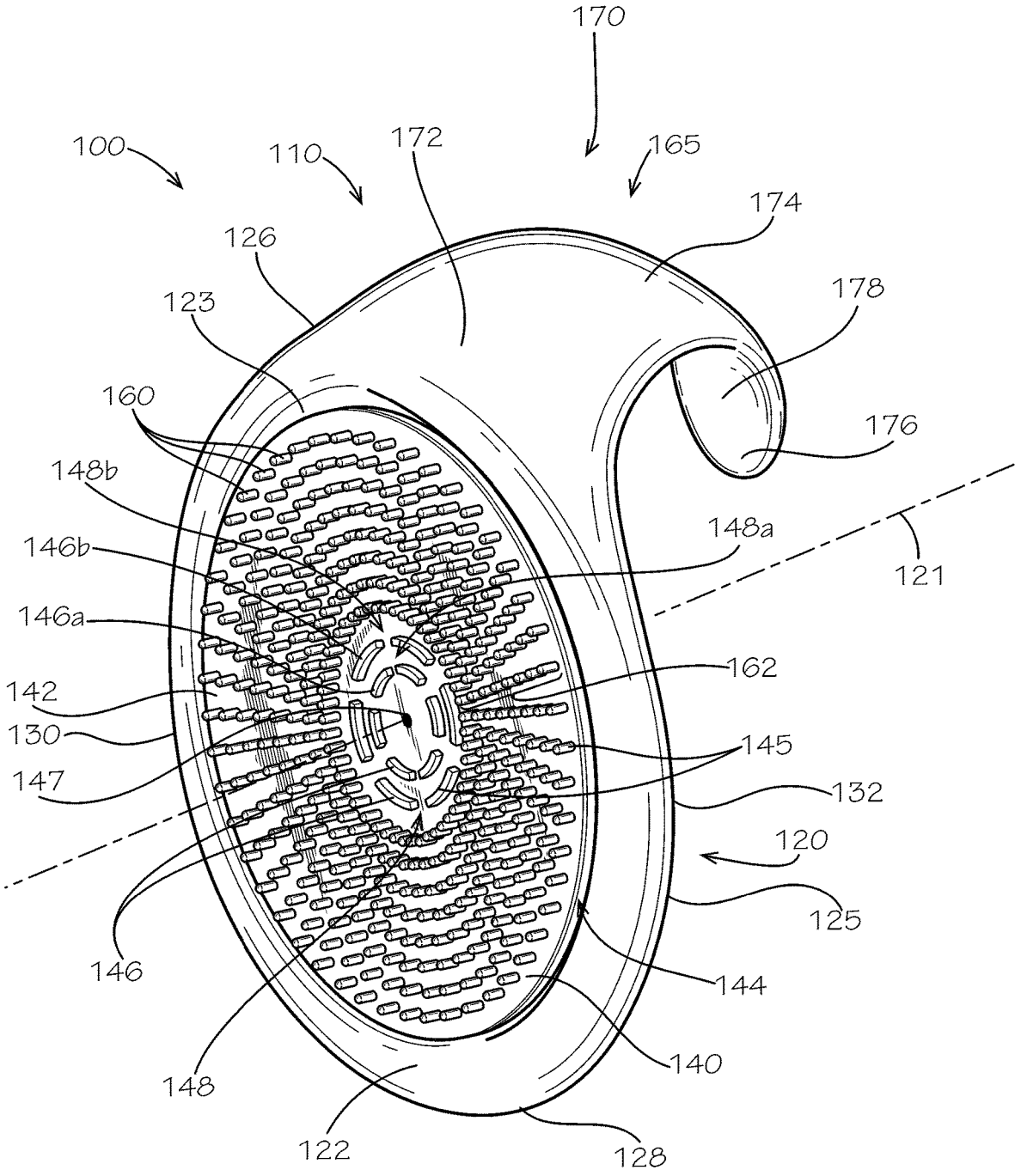
FIG. 1 is a front perspective view of a brush cleaning device, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a brush cleaning device and associated methods, systems, devices, and various apparatus. Example aspects of the brush cleaning device can comprise a cleaning pad and a hand engagement mechanism. It would be understood by one of skill in the art that the disclosed brush cleaning device is described in but a few exemplary aspects among many. No particular terminology or description should be considered limiting on the disclosure or the scope of any claims issuing therefrom.

FIG. 1 illustrates a first aspect of a brush cleaning device 100 according to the present disclosure. According to example aspects, the brush cleaning device 100 can be used to clean and remove cosmetic residue and/or bacteria from a cosmetics brush. Cosmetic residue can include, for example, makeups, serums, lotions, and the like. The brush cleaning device 100 can comprise a frame 110. As shown, the frame 110 can comprise a body 120 and a hand engagement mechanism 165 extending from a peripheral edge 125 of the body 120. In the present aspect, the body 120 can be define a substantially circular shape; however, in other aspects, the body 120 can define any other suitable shape. Furthermore, in the present aspect, the hand engagement mechanism 165 can be formed as a hook 170 and can be configured to engage a hand 580 (shown in FIG. 5) of a user; however, in other aspects, the hand engagement mechanism 165 can define any other suitable configuration. According to example aspects, the hand engagement mechanism 165 can be monolithically formed with the body 120 from a single piece of material, as shown. However, in other aspects, the hand engagement mechanism 165 can be separately formed and can be attached to the body 120 with a fastener (not shown). Example aspects of the fastener can be, for example, adhesive, welding, screws, or any other suitable fastener known in the art.

According to various example aspects, the frame 110 of the brush cleaning device 100 can be formed from a flexible and resilient material, such as, for example, silicone. In other aspects, the frame 110 can comprise any other suitable flexible and resilient material, or can be substantially rigid. For example, in other aspects, the frame 110 can comprise plastic, metal, wood, rubber, or any other suitable material known in the art. In still other aspects, the body 120 of the frame 110 and the hand engagement mechanism 165 of the frame 110 can be formed from differing materials.

Example aspects of the brush cleaning device 100 can also comprise a cleaning pad 140 coupled with the body 120. In the present aspect, the cleaning pad 140 can define a substantially circular shape. A center axis 121 can extend through a center 147 of the cleaning pad 140, as illustrated. According to example aspects, a brush head of the cosmetics brush can be engaged with the cleaning pad 140 to remove the cosmetic residue and/or bacteria from the brush head, as will be described in further detail below. Brush heads can comprise, for example, silicone, foam, synthetic or natural fibers, bristles, or hairs, or any other suitable brush head material known in the art. In some aspects, the cleaning pad 140 can be monolithically formed with the body 120, while other aspects, the cleaning pad 140 can be separately formed and attached to the body 120 with a fastener, such as, for example, an adhesive, welding, screws, or the like. According to example aspects, the body 120 can define a front body surface 122 and a back body surface 224 (shown in FIG. 2). The body can further define a top end 126, a bottom end 128, a left side 130, and a right side 132. Example aspects of the cleaning pad 140 can be attached to the front body surface 122 of the body 120, as will be described in further detail below.

Example aspects of the cleaning pad 140 can be formed from a flexible and resilient material, such as, for example, silicone. In other aspects, the cleaning pad 140 can comprise any other suitable flexible and resilient material, or can be substantially rigid. For example, in other aspects, the cleaning pad 140 can comprise plastic, metal, wood, rubber, or any other suitable material known in the art. In some aspects, the cleaning pad 140 can comprise the same material(s) as the frame 110, while in other aspects, the cleaning pad 140 can comprise a different material or combination of materials from the frame 110.

In the present aspect, the front body surface 122 of the body 120 can define a concave region 123 that can arc towards the back body surface 224 of the body. As shown, the cleaning pad 140 can be substantially nested within the concave region 123. In other aspects, however, the body 120 may not define the concave region 123, and the front body surface 122 can be substantially flat, convex, or can define any other suitable contour. According to example aspects, the cleaning pad 140 can define a front pad surface 142 and an opposite back pad surface (not shown). The back pad surface of the cleaning pad 140 can be coupled to the front body surface 122 of the body 120 at the concave region 123, such as by being monolithically formed with the front body surface 122 or being attached with a fastener, such as, for example, an adhesive, welding, screws, or the like. The front pad surface 142 of cleaning pad 140 can face outward from body 120, as shown. In some aspects, the back pad surface of the cleaning pad 140 can be contoured to match or substantially match the contour of the concave region 123.

According to example aspects, an annular channel 144 can be formed between the front body surface 122 of the body 120 and the back pad surface of the cleaning pad 140. As described above, cosmetic residue and bacteria can be removed from a cosmetics brush by rubbing a brush head of the brush against the cleaning pad 140. The annular channel 144 can define a sufficient width, such that any cosmetic residue and/or bacteria that may be deposited within the annular channel 144 during the cleaning of a brush can easily be washed out of the annular channel 144. For example, cosmetic residue and bacteria can be washed out of the annular channel 144 by soaking the brush cleaning device 100 in water or a cleanser or by allowing running water or cleanser to flow through the annular channel 144. In other aspects, however, the brush cleaning device 100 may not define the annular channel 144 between the body 120 and the cleaning pad 140.

Furthermore, as shown, in the present aspect, the front pad surface 142 of the cleaning pad 140 can define a substantially concave profile, such that the front pad surface 142 can arc inward toward the body 120. In some aspects, the contour of the front pad surface 142 of the cleaning pad 140 can be substantially similar to the contour of the back pad surface of the cleaning pad 140 and/or the contour of the front body surface 122 of the concave region 123 of the body 120. However, in other example aspects, the front pad surface 142 can be substantially flat, convex, or can define any other suitable contour.

According to example aspects, one or more projections 145 can extend from the front pad surface 142 of the cleaning pad 140. For example, in the present aspect, a plurality of projections 145 can include one or more ridges 146 and one or more nubs 160. According to example aspects, as shown, the projections 145 can extend substantially axially relative to the center axis 121; however, in other aspects, some or all of the projections 145 can extend in other directions. In the present aspect, each of the ridges 146 can be curved, as shown. However, in other aspects, the ridges 146 may not be curved. The curved ridges 146 can extend from the front pad surface 142 generally at or near the center 147 of the cleaning pad 140. In other aspects, the curved ridges 146 can be positioned at any other suitable location on the front pad surface 142. As shown, in example aspects, the ridges 146 can be arranged to form one or more concentric ridge circles 148. For example, in the current aspect, two concentric ridge circles 148 are formed around the center of the cleaning pad 140. As shown, the concentric ridge circles 148 can be concentric to one another and can also be concentric to the center 147 of the cleaning pad 140. The curved ridges 146 and concentric ridge circles 148 are described in further detail below with reference to FIG. 3.

As shown, the nubs 160 can also extend from the front pad surface 142 of the cleaning pad 140. In the present aspect, each of the nubs 160 can define an elongate shape, wherein a length of the nub 160 can be greater than a diameter or width of the nub 160. However, in other aspects, the nubs 160 may not define an elongate shape. As shown, according to example aspects, the elongate nubs 160 can substantially surround the concentric ridge circles 148 of curved ridges 146. For example, as shown, the elongate nubs 160 can be arranged in a plurality of linear series 162 extending generally radially outward from the concentric ridge circles 148 relative to the axis 121. Each elongate nub 160 in a linear series 162 can be spaced from adjacent nubs 160, and each linear series 162 of nubs 160 can be spaced from any adjacent linear series 162. In other aspects, however, the elongate nubs 160 may not be arranged in linear series 162 and can be arranged in any other suitable orientation. Furthermore, other aspects of the cleaning pad 140 can define more or fewer elongate nubs 160. The elongate nubs 160 are described in further detail below with reference to FIG. 3.

Other example aspects of the brush cleaning device 100 may not comprise the cleaning pad 140, and instead, the front body surface 122 of the body 120 can provide a cleaning surface for cleaning a cosmetics brush. For example, in other aspects, the projections 145 (e.g., the curved ridges 146 and the elongate nubs 160) can be formed on the front body surface 122 of the body 120.

Figure 5:
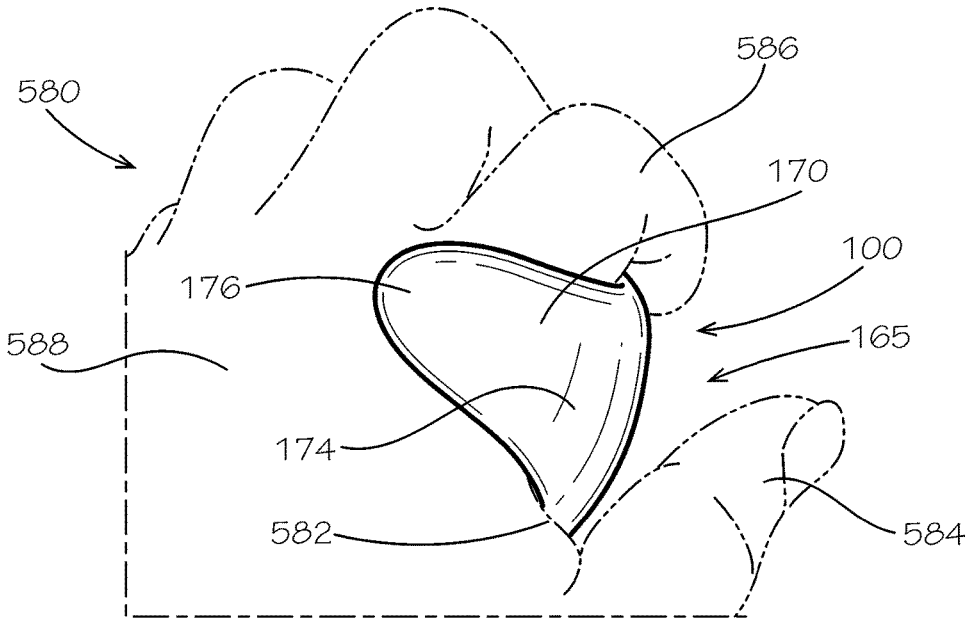
FIG. 5 is a rear perspective view of the brush cleaning device of FIG. 1 engaged with a user's hand.

As shown, in the present aspect, the hand engagement mechanism 165 (e.g., the hook 170) can define a first end 172 coupled to the peripheral edge 125 body 120 at or near the top end 126 thereof. The hand engagement mechanism 165 can further define a free second end 176 opposite the first end 172 and distal to the body 120. According to example aspects, an arcuate middle section 174 can extend between the first end 172 and the second end 176 of the hook 170. In some example aspects, the curve of the arcuate middle section 174 can be configured to substantially conform to a region 582 of a user's hand 580 disposed between a thumb 584 and a forefinger 586 of the user's hand 580, as will be described in further detail below (user's hand 580 and the region 582 disposed between the thumb 584 and forefinger are shown in FIG. 5).

In example aspects, as shown, the arcuate middle section 174 of the hook 170 can define a substantially convex curve, relative to the center axis 121, such that the arcuate middle section 174 can arc away from the body 120 of the frame 110. For example, in the present aspect, the arcuate middle section 174 can extend generally upward from the first end 172, relative to the orientation shown, and can extend generally downward towards the second end 176, relative to the orientation shown. Moreover, in the present aspect, the hook 170 can define a substantially smooth hand engagement surface 178 for engaging the hand 580 of a user. In various aspects, the hand engagement surface 178 can comprise a non-slip material, such as silicone, which can aid in retaining the hand engagement surface 178 in contact with the user's hand. In other aspects, however, the hand engagement surface 178 may comprise a textured surface or a gripping mechanism, such as, for example, a rubber pad, for improving the grip of the hand engagement surface 178 with the hand. However, other aspects of the hand engagement surface 178 may not comprise a non-slip material, textured surface, or gripping mechanism. Furthermore, in other aspects, the size and shape of the hand engagement mechanism 165, e.g., the hook 170, can vary, and can define any other suitable size and/or shape.

Figure 2:
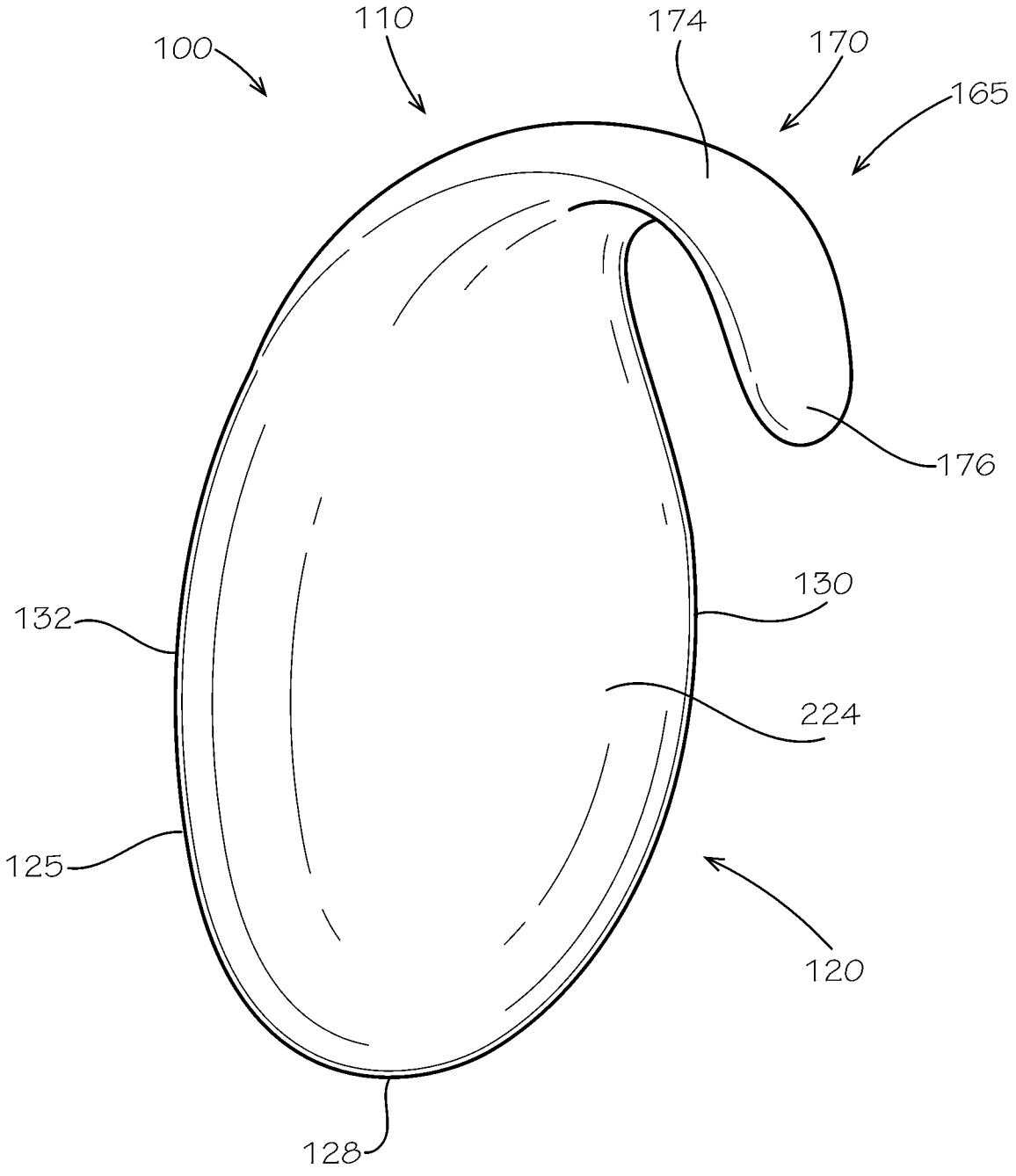
FIG. 2 is a rear perspective view of the brush cleaning device of FIG. 1.

FIG. 2 illustrates a rear perspective view of the brush cleaning device 100. As shown, example aspects of the back body surface 224 of the body 120 can define a convex profile, as shown. When using the brush cleaning device 100, the back body surface 224 of the body 120 can rest against a palm 690 (shown in FIG. 6) of a user's hand 580 (shown in FIG. 5). According to example aspects, the convex profile of the back body surface 224 can be similar to the contour of the user's palm 690. Furthermore, in some aspects, the contour of the back body surface 224 of the body 120 can be similar to the contour of the front body surface 122 (shown in FIG. 1) of the body 120. In other aspects, however, the back body surface 224 can define any other suitable contour. According to example aspects, the back body surface 224 of the body 120 can comprise a non-slip material, such as silicone, which can aid in retaining the back body surface 224 in contact with the user's palm 690. In other aspects, however, the back body surface 224 may comprise a textured surface or a gripping mechanism, such as, for example, a rubber pad, for improving the grip of the back body surface 224 with the palm 690. However, other aspects of the back body surface 224 may not comprise a non-slip material, textured surface, or gripping mechanism.

Figure 3:
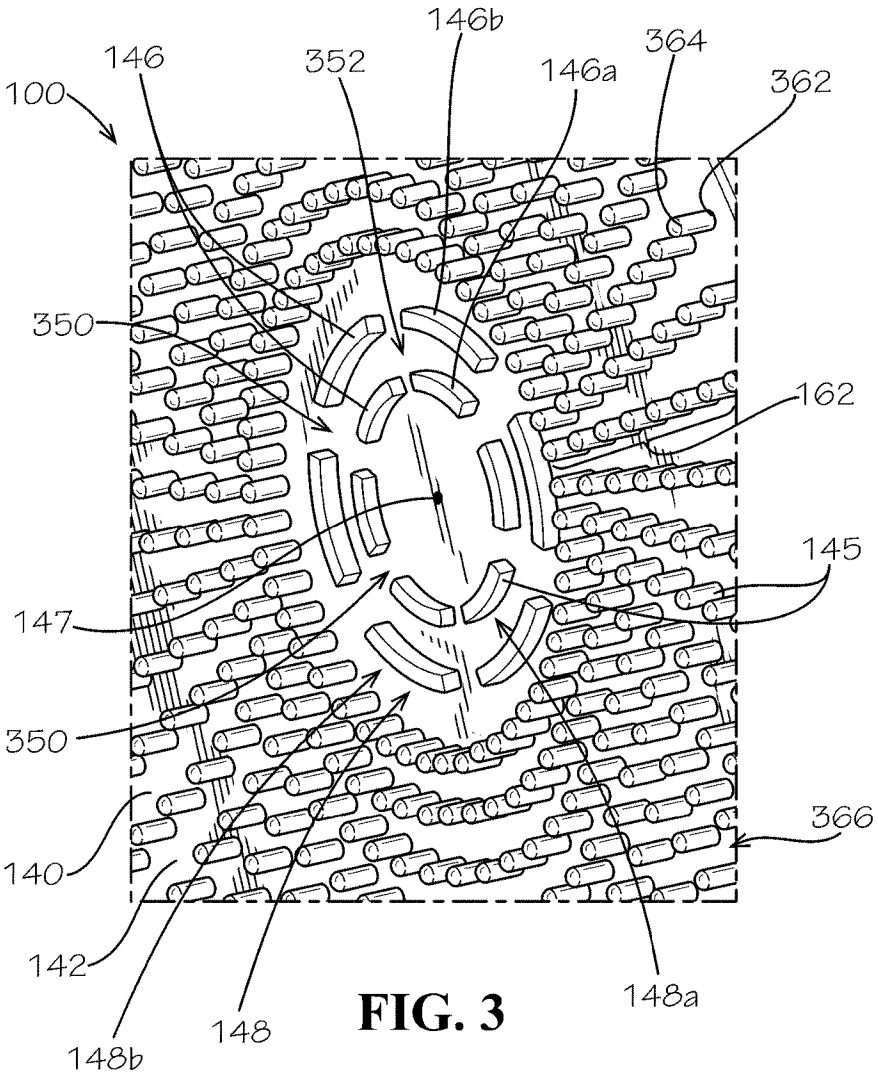
FIG. 3 is a detail perspective view of a cleaning pad of the brush cleaning device of FIG. 1.

FIG. 3 illustrates a detail view of the front pad surface 142 of the cleaning pad 140. As shown, the curved ridges 146 define the two concentric ridge circles 148—for example, a plurality of first, inner curved ridges 146*a* can define a first, inner concentric ridge circle 148*a*, and a plurality second, outer curved ridges 146*b* can define a second, outer concentric ridge circle 148*b*. In the present aspect, each of the inner and outer concentric ridge circles 148*a*,148*b* can comprise six of the inner and outer curved ridges 146*a*,146*b*, respectively. In other aspects, the cleaning pad 140 can comprise more or fewer concentric ridge circles 148, and the concentric ridge circles 148 can comprise more or fewer curved ridges 146. For example, in another example aspect, the cleaning pad 140 can comprise three concentric ridge circles 148, and each of the concentric ridge circles 148 can comprise a pair of substantially semi-circular curved ridges 146. Other aspects can comprise a single ridge circle 148. In such an aspect, the single ridge circle 148 is not concentric to another ridge circle 148, but can still be concentric to the center 147 of the cleaning pad 140.

In the present aspect, the inner concentric ridge circle 148*a* comprising the inner curved ridges 146*a* can define a smaller diameter than the outer concentric ridge circle 148*b* comprising the outer curved ridges 146*b*. As such, each of the inner curved ridges 146*a* of the inner concentric ridge circle 148*a* can define a shorter length than each of the outer curved ridges 146*b* of the outer concentric ridge circle 148*b*. In other aspects, the inner curved ridges 146*a* and the outer curved ridges 146*b* can define about the same length. In still other aspects, the inner curved ridges 146*a* can define varying lengths and/or the outer curved ridges 146*b* can define varying lengths.

As shown in the present aspect, a slot 350 can be defined between each of the adjacent inner curved ridges 146*a* and between each of the adjacent outer curved ridges 146*b*, such that adjacent curved ridges 146 in a ridge circle 148 can be spaced from one another. According to example aspects, the slots 350 between adjacent curved ridges 146 can allow any cosmetic residue or bacteria from the brush head that may become trapped within the concentric ridge circles 148 to be flushed out through the slots 350. However, in other aspects, each of the concentric ridge circles 148 can be formed by a continuous, annular curved ridge 146 not defining the slots 350. Furthermore, as shown, an annular groove 352 can be defined between each of the concentric ridge circles 148, such that the inner concentric ridge circle 148*a* can be spaced from the outer concentric ridge circle 148*b*.

As shown, each of the elongate nubs 160 can define a restrained end 362 attached to the front pad surface 142 of the cleaning pad 140 and free end 364 distal to the restrained end 362. As shown, in the present aspect, each of the elongate nubs 160 can define a substantially cylindrical shape, and each of the corresponding free ends 364 can define a domed profile, as shown. In other aspects, the elongate nubs 160 and the free ends 364 thereof can define any other suitable shape. Moreover, as shown, a gap 366 can be formed between each of the elongate nubs 160 and the surrounding, adjacent elongate nubs 160. According to example aspects, the gaps 366 can allow any cosmetic residue or bacteria from the brush head that may become trapped between the elongate nubs 160 to be flushed out through the gaps 366.

In the present aspect, the front pad surface 142 of the cleaning pad 140 can define a substantially smooth surface. However, in other aspects, instead of or in addition to the projections 145, the front pad surface 142 of the cleaning pad 140, or a portion thereof, can define a textured surface. For example, in a particular aspect, the front pad surface 142 can comprise a plurality of miniscule bumps, teeth, or the like (not shown) formed thereon to define a rough texture. The rough texture of the front pad surface 142 can be configured to aid in the removal of cosmetic residue and bacteria from the brush head.

As such, a method for using the brush cleaning device 100 to remove the cosmetic residue and bacteria from a cosmetics brush can comprise contacting a brush head of the cosmetics brush with the front pad surface 142 of the cleaning pad 140, and therefore penetrating the brush head with the plurality of projections 145 (e.g., the curved ridges 146 and the elongate nubs 160). A next step can comprise moving the brush head against the front pad surface 142 of the cleaning pad 140 (or alternatively, moving the front pad surface 142 against the brush head). For example, the movement can comprise swirling, rubbing, swiping, pressing, or otherwise moving the brush head against the front pad surface 142, or vice versa. In some aspects, the method can further comprise applying water and/or a cleanser to the brush head and/or the front pad surface 142 of the cleaning pad 140 to enhance the cleaning capability of the brush cleaning device 100.

According to example aspects, the projections 145 penetrating and moving within the brush head can aid in breaking up and removing residue and bacteria trapped in the brush head. Furthermore, in example aspects, the slots 350 formed between the curved ridges 146, the gaps 366 formed between the elongate nubs 160, and the annular channel 144 formed between the body 120 and the cleaning pad 140 can allow residue and bacteria removed from the brush head to be flushed out of the brush cleaning device 100, preventing a buildup of cosmetic residue and/or bacteria on the brush cleaning device 100. As such, the method can further comprise flushing cosmetic residue and/or bacteria from the brush cleaning device 100. The cosmetic residue and/or bacteria can be flushed from the brush cleaning device 100 by soaking the brush cleaning device 100 in water or a cleanser or with flowing water or a cleanser, for example and without limitation.

In some aspects, the concentric ridge circles 148 can also indicate where to engage the brush head with the brush cleaning device 100. Also, in some aspects, the concentric ridge circles 148 can indicate a location for applying the cleanser and/or a desired amount of cleanser to be applied. For example, in the depicted aspects, the concentric ridge circles 148 can indicate that the cleanser can be applied generally at the center 147 of the front pad surface 142 of the cleaning pad 140. Furthermore, the inner concentric ridge circle 148*a* can correspond to a preferred amount of cleanser for use in cleaning a small brush head, while the outer concentric ridge circle 148*b* can correspond to a preferred amount of cleanser for use in cleaning a large brush head. A user can determine the appropriate concentric ridge circle 148 corresponding to the size of the brush head to be cleaned, and can fill the inner or outer concentric ridge circles 148*a*,148*b* with the cleanser accordingly. As such, some aspects of the method can further comprise applying water and/or a cleanser at the location of the concentric ridge circles 148 and/or applying an amount of water and/or cleanser to the concentric ridge circles 148 that can correspond to the size of the brush head.

Figure 4:
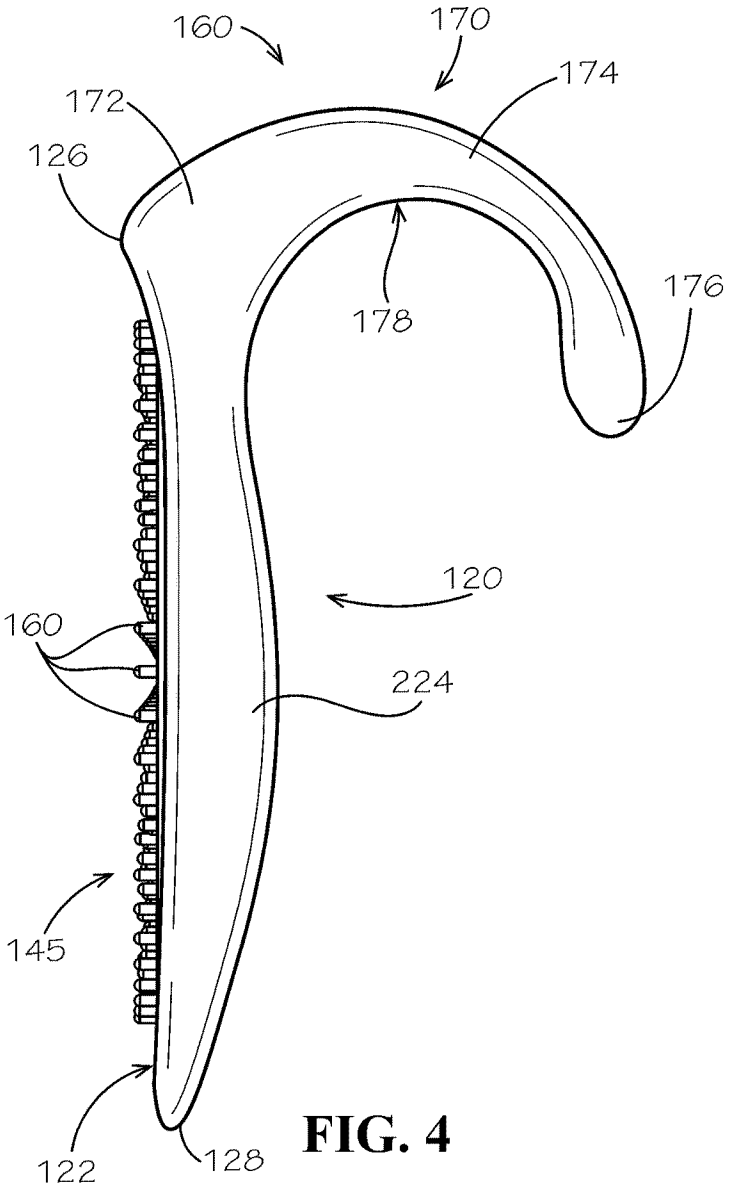
FIG. 4 is a side view of the brush cleaning device of FIG. 1.

FIG. 4 illustrates a side view of the brush cleaning device 100. In the current view, the convex profile of the back body surface 224 of the body 120 is clearly shown. Furthermore, according to example aspects, some or all of the projections 145, e.g., the elongate nubs 160 and/or the curved ridges 146 (shown in FIG. 1), can be configured to extend past the front body surface 122 of the body 120, as shown.

Figure 6:
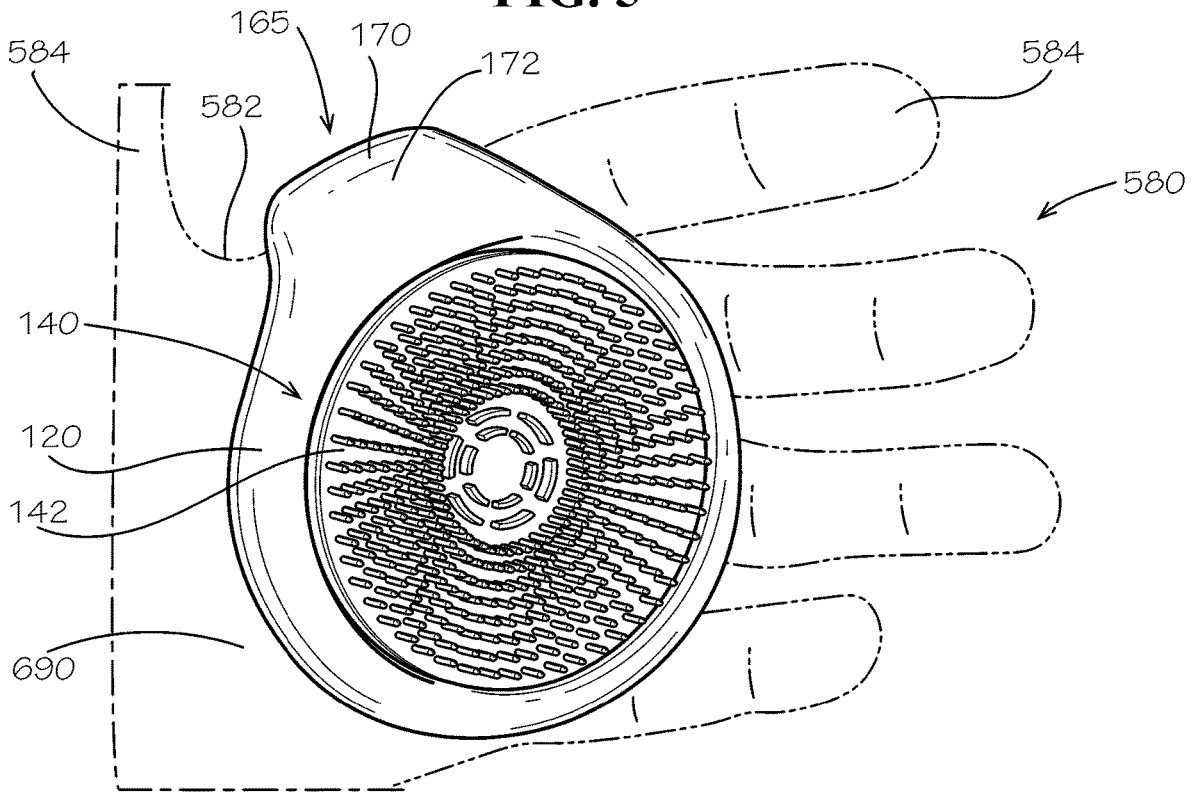
FIG. 6 is a front perspective view of the brush cleaning device of FIG. 1 engaged with the user's hand.

FIGS. 5 and 6 illustrate the brush cleaning device 100 engaged with the user's hand 580. Example aspects of the hand engagement mechanism 165, in this case, the hook 170, can wrap around the user's hand 580 to help prevent movement of the brush cleaning device 100 during use. As shown in FIG. 5, the arcuate middle section 174 of the hand engagement mechanism 165 can engage the user's hand 580 at the region 582 disposed between the thumb 584 and forefinger 586, as shown. Furthermore, the free second end 176 of the hand engagement mechanism 165 can be oriented proximate to, and in some cases can abut, a back side 588 of the user's hand 580 opposite the palm 690 (shown in FIG. 6). As such, the hand engagement mechanism 165 can wrap around the user's hand 580 to prevent lateral movement of the brush cleaning device 100 relative to the user's hand 580 during use.

Referring to FIG. 6, the back body surface 224 (shown in FIG. 2) of the body 120 can rest against the palm 690 of the user's hand 580, such that the front pad surface 142 of the cleaning pad 140 faces outward from the user's palm 690, as shown. The convex curve of the back body surface 224, as described above, can allow the body 120 to substantially conform to the contour of the user's palm 690. Other aspects of the back body surface 224 can define any other suitable profile, including but not limited to, flat or concave.

As such, the method of using the brush cleaning device 100 to remove cosmetic residue and/or bacteria from a cosmetics brush can further comprise engaging the hand engagement mechanism 165, e.g., the hook 170, of the brush cleaning device 100 with the region 582 of the user's hand 580 disposed between the thumb 584 and the forefinger 586 to prevent movement of the brush cleaning device 100 during use. The method can further comprise resting the body 120 of the brush cleaning device 100 against the palm 690 of the user's hand 580.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A cosmetics brush cleaning device comprising:

a frame comprising a body and a hand engagement mechanism coupled with the body; and a cleaning pad coupled with the frame, the cleaning pad comprising a front pad surface and a plurality of projections extending from the front pad surface, the plurality of projections comprising one or more elongate, arcuate ridges, the one or more elongate, arcuate ridges arranged to form a first ridge circle;

wherein each of the elongate, arcuate ridges is elongated along the front pad surface.

2. The cosmetics brush cleaning device of claim 1, wherein the body comprises a back body surface, the back body surface defining a convex profile.

3. The cosmetics brush cleaning device of claim 1, wherein the hand engagement mechanism defines a hook defining a hand engagement surface configured to engage a region of a user's hand disposed between a thumb and a forefinger of the user's hand.

4. The cosmetics brush cleaning device of claim 3, wherein the hook defines a first end coupled to the body, a second end opposite the first end, and an arcuate middle section extending between the first end and the second end.

5. The cosmetics brush cleaning device of claim 1, wherein:

the one or more elongate, arcuate ridges comprises a plurality of first elongate, arcuate ridges defining the first ridge circle; and the plurality of first elongate, arcuate ridges extend from a front pad surface of the cleaning pad.

6. The cosmetics brush cleaning device of claim 5, wherein the first ridge circle is concentric to a center of the cleaning pad.

7. The cosmetics brush cleaning device of claim 6, wherein the first ridge circle encircles the center of the cleaning pad, and wherein none of the plurality of projections are defined within the first ridge circle.

8. The cosmetics brush cleaning device of claim 5, further defining a slot formed between each adjacent pair of first elongate, curved ridges.

9. The cosmetics brush cleaning device of claim 5, wherein:

the one or more elongate, arcuate ridges further comprises a plurality of second elongate, arcuate ridges defining a second ridge circle;

the second ridge circle is concentric to the first ridge circle; and an annular groove is formed between the first ridge circle and the second ridge circle.

10. The cosmetics brush cleaning device of claim 9, wherein each of the second elongate, arcuate ridges defines a length that is greater than a length of each of the first elongate, arcuate ridges.

11. The cosmetics brush cleaning device of claim 1, wherein:

the plurality of projection comprises a plurality of nubs surrounding the first ridge circle;

the plurality of nubs extend from a front pad surface of the cleaning pad; and a gap is formed between each adjacent pair of nubs.

12. The cosmetics brush cleaning device of claim 1, wherein the hand engagement mechanism extends from a peripheral edge of the body.

13. The cosmetics brush cleaning device of claim 1, wherein:

the front pad surface defines an inner portion surrounding a center of the cleaning pad and an outer portion surrounding the inner portion;

the plurality of projections comprises a first plurality of projections extending from the inner portion and a second plurality of projections extending from the outer portion;

each of the projections of the first plurality of projections is one of the elongate arcuate ridges;

each of the projections of the second plurality of projections.

14. A cosmetics brush cleaning device comprising:

a frame comprising a body and a hand engagement mechanism coupled with the body, the body defining a front body surface, the front body surface defining a concave region; and a cleaning pad coupled with the frame, the cleaning pad comprising a projection, wherein the cleaning pad defines a front pad surface, the front pad surface defining a convex profile, the projection extending from the front pad surface, wherein the cleaning pad is nested within the concave region of the frame and confronts the front body surface;

wherein the projection defines an elongate, arcuate ridge that is arcuate along the front pad surface and elongated along the front pad surface.

15. The cosmetics brush cleaning device of claim 14, wherein a back pad surface of the cleaning pad is defined opposite the front pad surface, and wherein the back pad surface is coupled to the front body surface of the body.

16. The cosmetics brush cleaning device of claim 15, wherein an annular channel is formed between the back pad surface of the cleaning pad and the front body surface of the body.

17. The cosmetics brush cleaning device of claim 14, wherein:

the cleaning pad defines a center axis; and at least one projection of the plurality of projections extends substantially axially relative to the center axis.

18. A method for using a cosmetics brush cleaning device comprising:

providing the cosmetics brush cleaning device comprising a body, a hand engagement mechanism, and a cleaning pad, the cleaning pad comprising a plurality of projections including one or more elongate, arcuate ridges, wherein each of the elongate, arcuate ridges is elongated along a front pad surface of the cleaning pad;

engaging a user's hand with the hand engagement mechanism;

contacting a brush head of a cosmetics brush with the plurality of projections of the cleaning pad; and moving the brush head against the plurality of projections.

19. The method of claim 18, further comprising penetrating the brush head with the plurality of projections of the cleaning pad.

20. The method of claim 18, further comprising adding one of a cleanser or water to one of the cleaning pad the brush head.

21. The method of claim 18, wherein the hand engagement mechanism defines a hook and engaging the user's hand with the hand engagement mechanism comprises engaging a region of the user's hand with the hook, the region disposed between a thumb and a forefinger of the user's hand.

22. The method of claim 18, further comprising resting the body against a palm of the user's hand.

* * * * *